US009177754B2

(12) United States Patent
Hansen et al.

(10) Patent No.: US 9,177,754 B2
(45) Date of Patent: Nov. 3, 2015

(54) X-RAY TUBE COOLING BY EMISSIVE HEAT TRANSFER

(71) Applicant: Varian Medical Systems, Inc., Palo Alto, CA (US)

(72) Inventors: Wayne Hansen, Centerville, UT (US); Kasey Greenland, Murray, UT (US); Todd Parker, Kaysville, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 195 days.

(21) Appl. No.: 13/763,623

(22) Filed: Feb. 9, 2013

(65) Prior Publication Data

US 2014/0226792 A1 Aug. 14, 2014

(51) Int. Cl.

| | |
|---|---|
| ***H01J 35/10*** | (2006.01) |
| ***H01J 35/16*** | (2006.01) |
| ***H01J 35/06*** | (2006.01) |

(52) U.S. Cl.

CPC ..... *H01J 35/16* (2013.01); *H01J 35/06* (2013.01); *H01J 2235/1212* (2013.01); *H01J 2235/1237* (2013.01)

(58) Field of Classification Search

CPC ... H01J 35/06; H01J 35/16; H01J 2235/1212; H01J 2235/1237

USPC ..... 378/121, 141, 142, 119, 136

See application file for complete search history.

(56) References Cited

U.S. PATENT DOCUMENTS

| | | | | |
|---|---|---|---|---|
| 6,456,692 | B1 * | 9/2002 | Smith | 378/129 |
| 2003/0021377 | A1 * | 1/2003 | Turner et al. | 378/102 |
| 2010/0040201 | A1 * | 2/2010 | Lee | 378/136 |

* cited by examiner

*Primary Examiner* — Courtney Thomas

(74) *Attorney, Agent, or Firm* — Houst Consulting

(57) ABSTRACT

An x-ray tube includes an evacuated envelope, and a cathode assembly and an anode assembly both disposed in the evacuated envelope. The cathode assembly includes a cathode shield, a supporting body disposed inside the cathode shield, and an electron source attached to the supporting body and partially enclosed by the cathode shield. The anode assembly includes a target configured to produce x-rays upon impingement by electrons produced by the electron source. The cathode shield comprises a shield base material and a layer over at least a portion of the base material. The layer comprises an emissivity enhancer having an emissivity greater than the emissivity of the shield base material. The layer may comprise an emissive coating applied on the portion of the base material. Alternatively, the layer may comprise a greened surface formed by a greening process.

18 Claims, 2 Drawing Sheets

X-RAY TUBE COOLING BY EMISSIVE HEAT TRANSFER

TECHNICAL FIELD

This disclosure relates generally to x-ray devices, and in particular to cathode assemblies having enhanced heat transfer capability and x-ray tubes including the same.

BACKGROUND

X-ray tubes are widely used in medical diagnosis and treatment, industrial manufacturing, testing and inspection, security control, and a variety of other applications. An x-ray tube typically includes a cathode assembly having an electron source and an anode assembly having a target, both disposed within an evacuated enclosure. The target is oriented to receive electrons from the electron source. In operation, an electric current is applied to the electron source such as a filament, causing electrons to emit by thermionic emission. The electrons are then accelerated towards the target surface by applying a high voltage potential between the cathode and the anode. Upon striking the anode target surface, some of the resulting kinetic energy is released as x-rays. The x-rays ultimately exit the x-ray tube through a window in the x-ray tube, and interact in the patient or other objects for applications such as medical diagnostic and treatment, sample analysis, or various other applications.

X-ray tubes are typically operated under high temperatures, high voltages, and high vacuum conditions. For example, the operating temperature of an x-ray tube can be as high as 1300° C. The thermal stresses imposed by high operating temperature and temperature gradient often have various detrimental effects on the structure and performance of the cathode, the anode, and various other components in the x-ray tube. One area where such thermal effects are of particular concern relates to high voltage cables, which are employed in the x-ray tube to provide a high voltage potential between the cathode and the anode, and to power the filament for operation of an x-ray tube. Typical high voltage cable includes a cable having one or more electrical conductors electrically isolated from each other and wrapped in a protective covering or sheath. At an end of the cable is a terminal which typically includes a rubber element or rubber plug. The high operating temperature may impose detrimental effects on the rubber element, causing e.g. degradation of the electrical cable and potential high voltage failures.

An issue related with the thermal stresses is the high vacuum operating environment in the x-ray tube. Generally, the enclosure within which the cathode and the anode are disposed is evacuated to a relative high vacuum in order to ensure the removal of gases and other materials that may cause arcing due to the high potential difference between the cathode and the anode. However, thermal energy cannot be transferred by convection in vacuum since there contains no fluids or matters that are needed for transferring heat by convection. In some applications, the electron source e.g. filament in a cathode assembly is on continuously, creating a steady heat source. Conventional cathode assemblies employ polished cathode shields, which have low emissivity values. Therefore, conduction of heat from the filament heat source to the receptacle of the power cable is the primary path of heat transfer, causing concerns of high voltage failures.

Accordingly, there is a need for cooling x-ray tubes in general to ensure reliable operation under extreme conditions for sustained periods of time. There is a need for cooling cathode assemblies by emissive heat transfer to x-ray tube envelopes in order to eliminate or mitigate the detrimental effects on the x-ray tube components and to enhance the overall performance of the x-ray tube.

SUMMARY

In some exemplary embodiments, cathode shield and can of an x-ray tube assembly are made of stainless steel and are greened in a high temperature wet hydrogen process. This significantly increases the emissivity of the cathode shield and can. The greening of the cathode shield and can improves heat transfer out of the x-ray tube cathode by increasing the heat transfer due to radiation.

As compared with conventional polished cathode shields and non-greened can, the greened cathode shield and can according to this disclosure are better emitters which result in significantly greater heat transfer from the cathode shield to the can. This reduces the heat that conducts through the power cable receptacle and in turn to the rubber plug, eliminating or mitigating heat caused failures.

In some alternative embodiments, an emissive coating is applied on the cathode shield, can, or other x-ray tube components to improve their emissivity. This can improve the heat transfer due to radiation from the x-ray tube.

Using a cathode shield and can having a higher emissivity improves heat transfer out of an x-ray tube cathode and away from the rubber high voltage plug. Implementation of the method requires few changes to the x-ray tube assembly. Therefore, the disclosed method provides a cost effective way to increase heat transfer out of the cathode area of an x-ray tube.

This Summary is provided to introduce selected embodiments in a simplified form and is not intended to identify key features or essential characteristics of the claimed subject matter, nor is it intended to be used as an aid in determining the scope of the claimed subject matter. Other embodiments of the disclosure are further described in the Detail Description.

BRIEF DESCRIPTION OF THE DRAWINGS

These and other features and advantages of the disclosed methods and apparatuses will become better understood upon reading of the following detailed description in conjunction with the accompanying drawings and the appended claims provided below, where:

DETAILED DESCRIPTION

Figure 1:
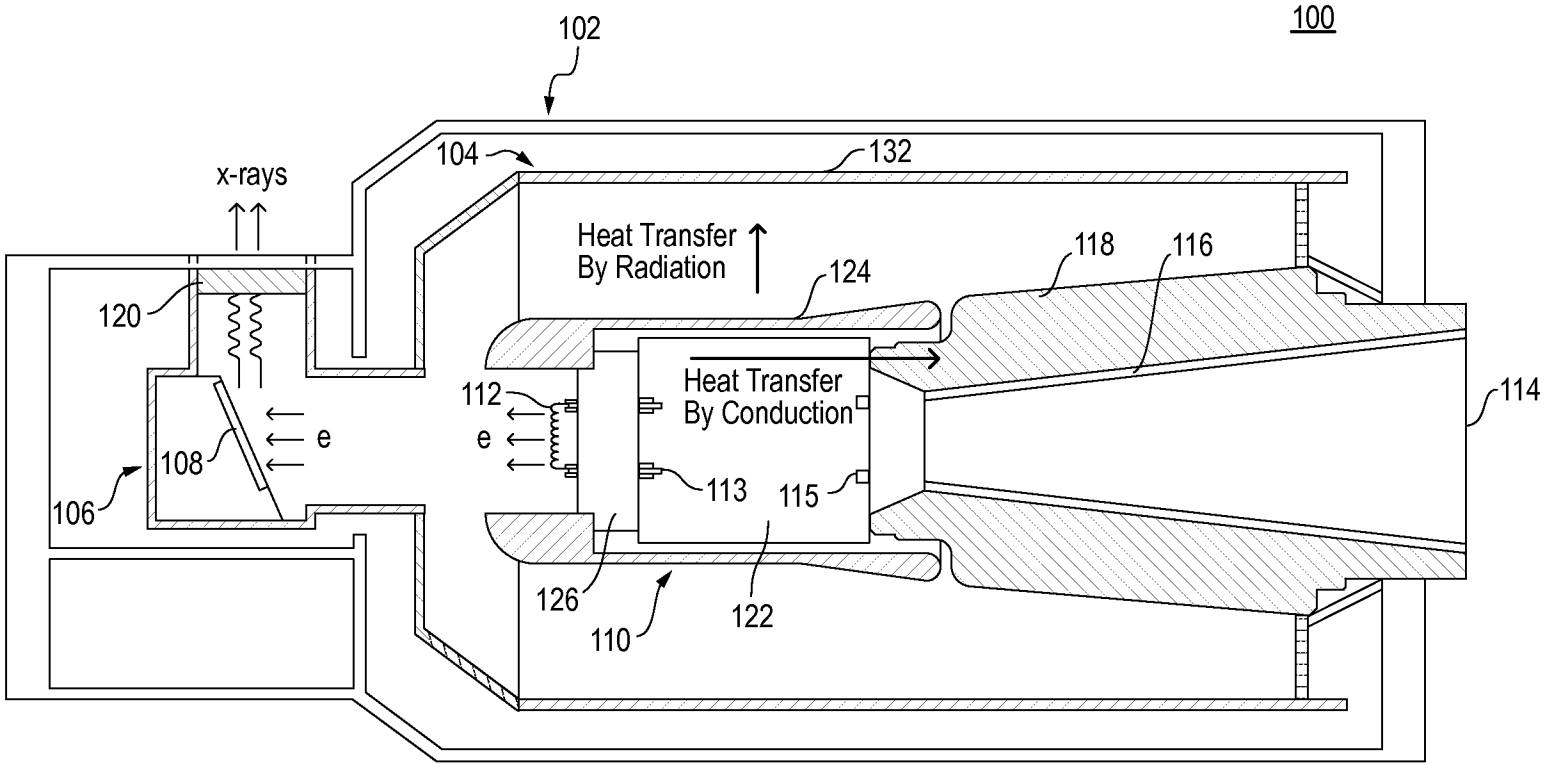
FIG. 1 is a schematic representation of an x-ray tube according to some embodiments of this disclosure.

Various embodiments of methods and devices for cooling x-ray tubes or cathode assemblies by emissive heat transfer are described. It is to be understood that the disclosure is not limited to the particular embodiments described as such may, of course, vary. An aspect described in conjunction with a particular embodiment is not necessarily limited to that embodiment and can be practiced in any other embodiments. For instance, while various embodiments are shown and described in conjunction with a cathode assembly, it will be appreciated by one of ordinary skill in the art that the described methods can also be employed on other components in an x-ray device.

Various relative terms such as "above," "below," "top," "bottom," "height," "depth," "width," and "length," etc. may be used to facilitate description of various embodiments. The relative terms are defined with respect to a conventional orientation of a structure and do not necessarily represent an actual orientation of the structure in manufacture or use. The following detailed description is, therefore, not to be taken in a limiting sense. As used in the description and appended claims, the singular forms of "a," "an," and "the" may include plural references unless the context clearly dictates otherwise.

As used herein, the term "greening" refers to a process of oxidizing the base material of an x-ray tube component such as a cathode shield, a cathode can etc. Depending on the base material and the process, oxidization of the component base material may take on several different colors, and an oxide, a nitride, or a carbide layer may form on the surface of the component to yield an emissivity greater than that of the component base material.

As used herein, the term "emissive coating" refers to a coating applied on the surface of an x-ray tube component that yields a greater emissivity than that of the component base material.

As used herein, the term "emissivity" ($\in$) refers to a relative ability of an x-ray tube component to emit energy by radiation. The emissivity of a component can be referred to as a ratio of energy radiated by the component to energy radiated by a black body at the same temperature. In general, a real component would have an emissivity $\in<1$ whereas a perfect black body would have an emissivity $\in=1$.

Components of an x-ray tube such as a cathode shield and a cathode can etc. may be treated to enhance the emissivity of the surfaces of the components to improve heat transfer by radiation to other cooler places. The components may be treated in a greening process, in which the base materials of the components are oxidized. Depending on the base materials and the process conditions, the oxidation states can take on several different colors, and will yield different emissivity results. It is possible to develop nitrides or other emissivity enhancing surface layers using different base materials in the greening process. Alternatively, the components can be applied with an emissive coating which has an enhanced emissivity. The coating or the combination of the base material with coating enhances the emissivity of the components well beyond the emissivity of the machined or polished base material. Preferably, the coating should be stable under high voltages, high temperatures, and high vacuum environment. Alternatively, the components can be constructed with a material that has a high emissivity and meets the high voltage, high temperature, and high vacuum requirements for x-ray tube operation.

Accordingly, in some embodiments, a cathode assembly includes a cathode shield, a supporting body disposed inside the cathode shield, and an electron source attached to the supporting body and partially enclosed by the cathode shield. The cathode shield comprises a shield base material. At least a portion of the cathode shield is treated by a greening process, forming a layer converted from the shield base material. The layer possesses an emissivity greater than the emissivity of the shield base material.

The cathode shield may comprise a shield body having an internal surface and an external surface and providing a space for housing the electron source, the cathode support, and other components of the cathode assembly. Either the internal surface or an external surface can be treated by the greening process. In some embodiments, the entire internal and external surfaces can be treated by the greening process.

In some embodiments, an x-ray tube includes an evacuated envelope, and a cathode assembly and an anode assembly both disposed in the evacuated envelope. The cathode assembly includes a cathode shield, a supporting body disposed inside the cathode shield, and an electron source attached to the supporting body and partially enclosed by the cathode shield. The cathode assembly may also include a cathode head attached to the supporting body and partially enclosed by the cathode shield. The anode assembly includes a target configured to produce x-rays upon impingement by electrons produced by the electron source. The cathode shield comprises a shield base material, and at least a portion of the cathode shield is treated by a greening process forming a layer converted from the shield base material. The layer possesses an emissivity greater than the emissivity of the shield base material.

The x-ray tube may further include an insulating body defining an elongate receptacle configured to receive an electrical cable assembly to be coupled to the cathode assembly. At least a portion of the insulating body may be disposed inside the cathode shield. The insulating body may be constructed with a material comprising ceramics.

The evacuated envelope of the x-ray tube may include a cathode can surrounding the cathode assembly. The cathode can may comprise a can base material. At least a portion of the cathode can may be treated by a greening process, forming a layer converted from the can base material, which has an emissivity greater than the emissivity of the can base material. The cathode can may be configured to surround the cathode assembly and a substantial portion of the insulating body.

In some embodiments, an x-ray tube includes an evacuated envelope, and a cathode assembly and an anode assembly both disposed in the evacuated envelope. The cathode assembly includes a cathode shield, a supporting body disposed inside the cathode shield, and an electron source attached to the supporting body and partially enclosed by the cathode shield. The cathode assembly may also include a cathode head attached to the supporting body and partially enclosed by the cathode shield. The anode assembly includes a target configured to produce x-rays upon impingement by electrons produced by the electron source. The cathode shield comprises a shield base material and a layer over at least a portion of the base material. The layer comprises an emissivity enhancer having an emissivity greater than the emissivity of the shield base material. The layer may comprise an emissive coating applied on the portion of the base material. Alternatively, the layer may comprise a greened surface formed by a greening process.

The x-ray tube may further include an insulating body defining an elongate receptacle configured to receive an electrical cable assembly to be coupled to the cathode assembly. At least a portion of the insulating body may be disposed inside the cathode shield. The insulating body may be constructed with a material comprising ceramics.

The evacuated envelope of the x-ray tube may include a cathode can surrounding the cathode assembly. The cathode can may comprise a can base material and an additional layer over at least a portion of the can base material. The additional layer comprises an additional emissivity enhancer having an emissivity greater than the emissivity of the can base material.

Exemplary embodiments will now be described with reference to the figures. It should be noted that some figures are not necessarily drawn to scale. The figures are only intended to facilitate the description of specific embodiments, and are not intended as an exhaustive description or as a limitation on the scope of the invention.

Referring to FIG. 1, an exemplary x-ray tube 100 according to this disclosure will now be described. In general, the x-ray tube 100 may include an outer housing 102, within which an evacuated enclosure 104 may be disposed. Disposed within the evacuated enclosure 104 may be an anode assembly 106 having a target 108, and a cathode assembly 110 having an electron source 112. The anode assembly 106 may be spaced apart from and disposed opposite to the cathode assembly 110. The cathode assembly 110 may be connected to an electrical power source (not shown) via a high voltage cable assembly 114, which may be received in a receptacle 116 defined by an insulating body such as a ceramic body 118. In operation, the high voltage cable assembly 114 may charge the electron source 112 of the cathode assembly 110 with a heating current, causing electrons to emit by thermionic emission. The electrons may be accelerated towards the target surface 108 by a high voltage potential between the cathode 110 and the anode 106, e.g. on the order of about 40 kV to about 200 kV, which may be provided by the high voltage cable 114. Upon striking the anode target surface 108, some of the resulting kinetic energy may be released as x-rays. The vacuum enclosure 104 may include a window 120. The x-rays may pass through the window 120 and ultimately exit the x-ray tube 100 to interact in the patient or other objects for applications such as medical diagnostic and treatment, sample analysis, or various other applications.

The anode assembly 106 may include a target 108, which may comprise tungsten, molybdenum, an alloy of molybdenum, or other suitable high Z-materials. The target 108 may include a surface that is oriented to receive electrons from the cathode assembly 110. The anode assembly 106 may be rotatably supported by a rotor shaft and a bearing assembly (not shown). Alternatively, the anode assembly 106 may be stationary, as shown.

The cathode assembly 110 may include one or more electron sources 112, a cathode support 122, and a cathode shield 124. The cathode assembly 110 may also include one or more cathode heads 126.

The electron source 112 may be any of a variety of different electron emitters, including filaments. The filament 112 may comprise a wire made of tungsten or similar material that is wound to form a helix. The ends of the filament 112 may be electrically connected to electrical connectors 113, 115. The electrical connectors 115 may be coupled to the high voltage cable 114, which may include rubber elements or plugs (not shown). The high voltage cable 114 may be received in the receptacle 116 defined by the insulating body 118, and connected to a high voltage power source (not shown). Thus, the high voltage cable 114 may provide an electrical voltage bias to the cathode 110 and an electric current to the filament 112 during the operation of the x-ray tube 100. One or more electron sources may be included in the cathode assembly 110.

The cathode support 122 may provide support for the cathode assembly 110, including the electron source 112, the cathode head 126, the cathode shield 124, and other components of the cathode assembly 110. The cathode support 122 may be constructed from any suitable materials, including stainless steel or other metals such as nickel, nickel alloys, and copper alloys, etc. The cathode support 122 may be manufactured for example, by casting, milling, and/or forging. The shape of the cathode support 122 may correspond with the shape desired for a particular cathode assembly 110. By way of example, the cathode support 122 may have a substantially cylindrical, cubical or polygonal shape or other regular or irregular shapes. The cathode support 122 may have angled or indented surfaces as desired in different configurations.

One or more cathode heads 126 may be included in the cathode assembly 110. Each cathode head 126 may be mounted to the cathode support 122 and positioned proximate to an electron source 112. The cathode head(s) 126 may be shaped or configured to assist in defining the focal spot dimension of the electron source(s) 112. In some embodiments, the cathode head(s) 126 may be configured to control the speed or direction of the electrons emitted by the electron source(s) 112. For example, the cathode head(s) 126 may be gridded. The gridded configuration of the cathode head(s) 126 may allow controlling the speed and direction of the electrons emitted from the electron source(s) 112 through the use of electrical forces exerted on the emitted electrons. The cathode head(s) 126 may be separate elements and separately mounted to the cathode support 122. Alternatively, the cathode head(s) 126 may be integral with the cathode support 122. The cathode head(s) 126 may be constructed with a metallic material such as nickel, stainless steels, alloy steels, or combinations of these and/or other metals. In some embodiments, the cathode head(s) 126 may be manufactured using stainless steel. In embodiments wherein the cathode head(s) 126 is integrally formed with the cathode support 122, the cathode head(s) 126 may be formed using the same materials used for the cathode support 122. The cathode head(s) 126 may be formed by casting, milling, and/or forging.

The cathode shield 124 may enclose or at least partially enclose the electron source 112, the cathode heads 126, the cathode support 122, and other components of the cathode assembly 110. For example, the cathode shield 124 may partially enclose the electron source(s) 112 within the cathode assembly 110. By at least partially enclosing the electron source(s) 112, the cathode shield 124 can protect the electron source(s) 124 and other components from damages caused by, for example, physical contact with an external object. In some embodiments, the cathode shield 124 may be a high voltage shield that protects the cathode assembly 110 from damages caused by arcing. In some embodiments, the cathode shield 124 may include an emissivity enhancer to facilitate heat transfer by radiation to cooler places, as described in more detail below.

Figure 2:
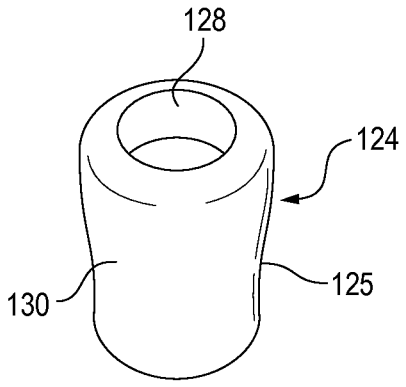
FIG. 2 is a schematic representation of a cathode shield according to some embodiments of this disclosure.

The cathode shield 124 may comprise a shield body 125, as shown in FIG. 2. In some embodiments, the shield body 125 may be substantially cylindrical and open at both end portions, providing a space for housing the electron source 112, the cathode head 126, the cathode support 122, and other components of the cathode assembly 110. In alternative embodiments, the shield body 125 may be configured in any shape desired or necessary for different cathode assembly configurations. For example, the shield body 125 may have a generally square, rectangular, oval, circular, triangular, or any other regular or irregular internal and/or external cross-sectional shape. In some embodiments, at least a portion of the internal surface or contour of the shield body 125 can be shaped and sized to match the shape and size of the cathode support 122 enclosed inside the cathode shield 124. As shown in FIG. 2, a substantially cylindrical shield body 125 may accommodate a substantially cylindrically shaped shield support 122 inside. In other embodiments, the geometry of the shield body 125 may be varied as desired to match up with different cathode support 122 geometries.

The cathode shield 124 can be manufactured using a number of different materials. For example, the cathode shield 124 can be manufactured using stainless steel or other steels.

In alternative embodiments, the cathode shield 124 may comprise any number of other metals that is suitable for sustained use in high temperatures, high voltages, and vacuum environments that characterize the operation of typical x-ray tubes. Other exemplary materials include but are not limited to high purity nickel, molybdenum, iron, alloys thereof, and so on. The cathode shield 124 can be formed by casting, milling, and/or forging, etc.

In some embodiments, the cathode shield 124 may be treated to enhance the emissivity of the surfaces of the cathode shield 124 to improve heat transfer by radiation to other cooler places. As described above, in some applications the electron source 112 may be on continuously, creating a steady heat source. The heat may reach extremely high temperatures and should be continuously removed to avoid or mitigate the detrimental effects on the structure and performance of x-ray tube components. Conventional cathode assemblies employ polished cathode shields, which have low emissivity values. Therefore, in conventional x-ray tubes, conduction of heat from the filament heat source 112 to the power cable ceramic 118 is the primary path of heat transfer, causing concerns of degradation and high voltage failures of the power cable 114, including the rubber plugs.

In some embodiments, the cathode shield 124 may be treated in a greening process to form an emissive layer with enhanced emissivity on at least a portion of the shied body surface. The emissive layer can improve the emissive surface properties of the cathode shield 124. An increase in the emissivity of the cathode shield 124 can increase the rate at which that cathode shield 124 radiates heat. The greened cathode shield 124 can thus reduce the conduction of damaging heat from the cathode area to the electrical cable 114 and its rubber plugs through the cable ceramic 118, ensuring the stability of the electrical cable 114, which in turn extends the operational life of the x-ray tube 100.

In some embodiments, the greening process may be conducted in a wet hydrogen atmosphere at temperatures of about 900° C. or higher. Oxidation may occur to provide a green surface of enhanced emissivity. By way of example, the cathode shield 124 may be constructed from stainless steel. A greening process of the cathode shield 124 of stainless steel may yield a green chromium oxide surface with enhanced emissivity. Depending on the base material and the process conditions, oxidation can take on several different colors to yield different emissivity results. It is possible to develop nitrides or carbides or other emissivity enhancing surface layers using different base materials in a greening process. The greened shield body 124 may increase the transfer of heat by radiation from the cathode area to adjacent cooler places, e.g. to the evacuated enclosure 104 due to the enhanced emissivity of the greened surface. The increased transfer of heat by radiation may in turn reduce the conduction of heat from the cathode 110 to the power cable ceramic 118, thereby reducing the risks of potential high voltage failures.

The surface of the cathode shield 124 may be properly prepared e.g. by polishing prior to the greening process in order to obtain more effective results. After the greening process, cleaning of the finished surface may be desirable before the cathode shied is employed in the x-ray tube. Polishing and cleaning of the cathode shield 124 may be conducted using the methods well known in the art.

At least a portion of the cathode shield surface may be treated in a greening process. FIG. 2 shows a shield body 125 having an internal surface 128 and an external surface 130. In some embodiments, either the external surface 130 or the internal surface 128 of the shield body 125 may be greened. Alternatively, the entire surface of the shield body 125, including the internal surface 128 and external surface 130, may be greened in a more cost effective way.

In alternative embodiments, an emissive coating may be applied on at least a portion of the surface of the shield body 125 to enhance radiant transfer of heat from the cathode area to other cooler places. The emissive coating may be an inorganic coating which has an emissivity greater than the emissivity of the machined or polished base material. In some embodiments the emissive coating may have an emissivity of 0.4 or greater, or 0.6 or greater, or 0.8 or greater. In some embodiments, the emissive coating exhibits good properties under high temperatures and high vacuum to ensure that the coating material will not break down under the extreme operating conditions. In some embodiments, the emissive coating possesses a similar coefficient of thermal expansion to that of the cathode shield base material so that flaking of the coating will not occur due to thermal mismatch between the coating and the coated component in high temperatures. In some embodiments, the emissive coating has good dielectric properties and provides corrosion and oxidation protection for the shield body base material. Exemplary coatings that can be applied to the shield body surface include, but are not limited to, oxides, nitrides, and carbides of titanium, zirconium, molybdenum, aluminum, or other refractory metals. Some specific emissive coatings include, but are not limited to, titanium oxide, aluminum oxide, mixtures of titanium oxide and aluminum oxide, titanium nitride, titanium aluminum nitride (TiAlN).

The emissive coating may be applied to the cathode shield 124 by any suitable methods e.g. by deposition processes such as chemical vapor deposition (CVD), physical vapor deposition (PVD), vacuum plasma spray, high velocity oxygen fuel thermal spray, detonation thermal spraying, and standard low pressure spraying, etc. These processes may deposit a highly emissive coating typically used in manufacturing high performance x-ray cathode assemblies. The surface of the cathode shield may be properly prepared or cleaned before and after application of the emissive coating using the methods well known in the art.

In some alternative embodiments, the cathode shield 124 may be constructed with a material that has a high emissivity value and meets the high voltage, high temperature, and high vacuum requirements for x-ray tube operation. Exemplary materials having high emissivity values include but are not limited to titanium nitride, titanium aluminum nitride (TiAlN).

Figure 3:
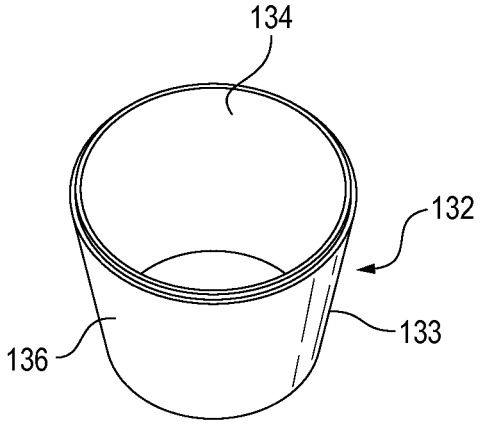
FIG. 3 is a schematic representation of a cathode can according to some embodiments of this disclosure.

It should be noted that while the cathode shield 124 may be greened to form an emissive layer, or applied with an emissive coating, or constructed with a material having a high emissivity value to enhance heat transfer by radiation, the disclosed methods are not limited to the cathode shield. Other components in the x-ray tube can be greened to form an emissive layer, or applied with an emissive coating, or constructed with a material having a high emissivity value. Returning to FIG. 1, for example, the cathode can 132, which may form a portion of the evacuated enclosure 104, may be greened to form an emissive layer, or applied with an emissive coating, or constructed with a material having a high emissivity, in a way as described above in connection with the cathode shield. FIG. 3 shows an exemplary cathode can in a substantially cylindrical shape. The cathode can 132 may have a can body 133, an internal surface 134 and an external surface 136. In some embodiments, the external surface 136 or the internal surface 134 of the can body 133 may be greened or applied with an emissive coating. Alternatively, the entire surface of the can body 133, including the internal surface 134 and the external surface 136, may be greened or coated with an emissive coating in a more cost effective way.

Figure 4:
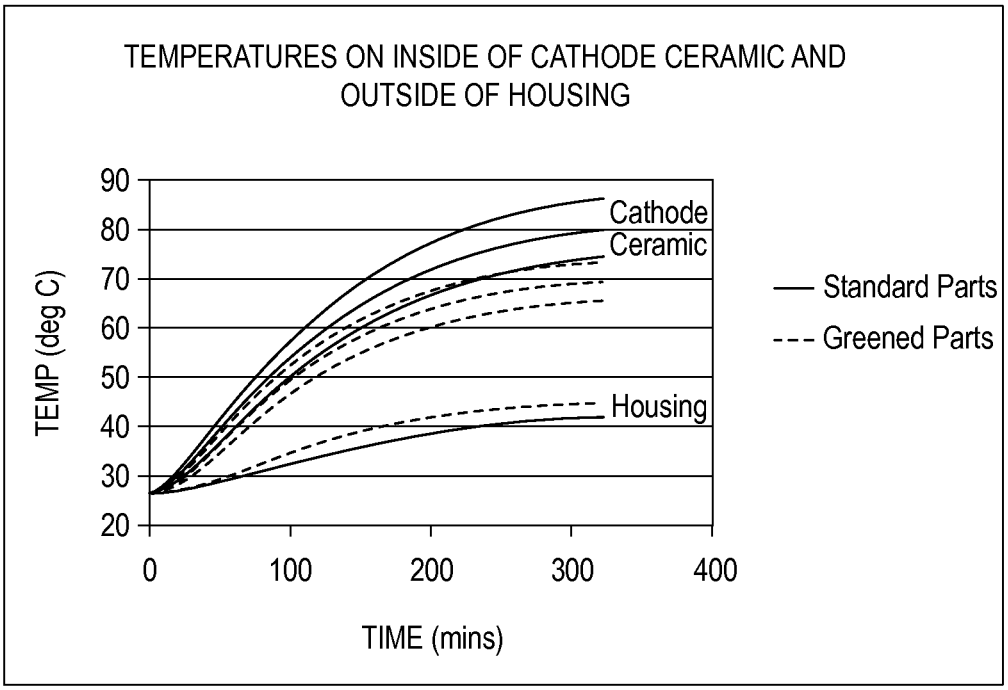
FIG. 4 is a graph showing some results of temperature tests on some greened and non-greened parts in an x-ray tube according to some embodiments of this disclosure.

The disclosed methods and devices provide an effective way to increase heat transfer out of the cathode area of an x-ray tube. FIG. 4 is a graph showing some results of temperature tests on some greened and non-greened parts in an x-ray tube according to some embodiments of this disclosure. In FIG. 4, the solid lines represent the temperatures on inside of the cathode ceramic (power cable receptacle) and outside of the housing when conventional cathode shield and can (standard parts) were used in the x-ray tube. The dash lines represent the temperatures on the inside of the cathode ceramic 118 and the outside of the housing 102 when the cathode shield 124 and can 132 were greened (greened parts) and used in the x-ray tube 100. As shown in FIG. 4, the use of greened cathode shield and can resulted in significantly lower temperatures on the inside of the cathode ceramic as compared to the use of standard parts. This indicates that more heat were transferred by radiation out of the cathode area to the cooler housing, as manifested by the higher temperatures on the outside of the housing when greened cathode shield and can were used in the x-ray tube.

Exemplary embodiments of cathode shield, cathode assembly, and x-ray tube including the cathode shield and can are described. Those skilled in the art will appreciate that various modifications may be made within the spirit and scope of the disclosure. All these or other variations and modifications are contemplated by the inventors and within the scope of the disclosure.

The invention claimed is:

1. An x-ray tube, comprising:

an evacuated envelope;

a cathode assembly disposed in the evacuated envelope, the cathode assembly comprising a cathode shield, a supporting body disposed inside the cathode shield, and an electron source attached to the supporting body and partially enclosed by the cathode shield; and an anode assembly disposed in the evacuated envelope, the anode assembly comprising a target configured to produce x-rays upon impingement by electrons produced by the electron source;

wherein the cathode shield comprises a shield base material, and at least a portion of the cathode shield comprises a first layer converted from the shield base material, the first layer possesses a first emissivity greater than an emissivity of the shield base material.

2. The x-ray tube of claim 1 wherein the shield base material comprises stainless steel.

3. The x-ray tube of claim 1 wherein the cathode assembly further comprises a cathode head attached to the supporting body and partially enclosed by the cathode shield.

4. The x-ray tube of claim 1 further comprising an insulating body defining an elongate receptacle configured to receive an electrical cable assembly to be coupled to the cathode assembly, wherein at least a portion of the insulating body is disposed inside the cathode shield.

5. The x-ray tube of claim 4 wherein the insulating body comprises ceramics.

6. An x-ray tube, comprising:

an evacuated envelope;

a cathode assembly disposed in the evacuated envelope, the cathode assembly comprising a cathode shield, a supporting body disposed inside the cathode shield, and an electron source attached to the supporting body and partially enclosed by the cathode shield; and an anode assembly disposed in the evacuated envelope, the anode assembly comprising a target configured to produce x-rays upon impingement by electrons produced by the electron source;

a cathode can disposed in the evacuated envelope surrounding the cathode assembly, wherein the cathode shield comprises a shield base material, and at least a portion of the cathode shield comprises a first layer converted from the shield base material, the first layer possesses a first emissivity greater than an emissivity of the shield base material; and wherein the cathode can comprises a can base material, and at least a portion of the cathode can comprises a second layer converted from the can base material, the second layer possesses a second emissivity greater than an emissivity of the can base material.

7. The x-ray tube of claim 6 wherein the cathode can is substantially cylindrical configured to surround the cathode assembly and a substantial portion of the insulating body.

8. A cathode assembly, comprising:

a cathode shield;

a supporting body disposed inside the cathode shield; and an electron source attached to the supporting body and partially enclosed by the cathode shield;

wherein the cathode shield comprises a shield base material, and at least a portion of the cathode shield comprises a layer converted from the shield base material, the layer possesses an emissivity greater than an emissivity of the shield base material.

9. The cathode assembly of claim 8 wherein the shield base material comprises stainless steel.

10. The cathode assembly of claim 8 wherein the cathode shield comprises a generally cylindrical portion comprising an internal surface and an external surface and having generally circular internal and external cross-sections.

11. The cathode assembly of claim 10 wherein the first layer is on the entire internal and external surfaces and is converted from the shield base material by oxidation.

12. A cathode shield for use in an X-ray tube, comprising a shield body configured to partially enclose an electron source attached to a supporting body disposed inside the shield body, wherein the shield body comprises a shield base material, and at least a portion of the shield body comprises a layer converted from the shield base material, the layer possesses an emissivity greater than an emissivity of the shield base material.

13. The cathode shield of claim 12 wherein the shield base material comprises stainless steel.

14. The cathode shield of claim 12 wherein the shield body comprises a generally cylindrical portion comprising an internal surface and an external surface and having generally circular internal and external cross-sections.

15. The cathode shield of claim 14 wherein the layer is on the entire internal and external surfaces and is converted from the shield base material by oxidation.

16. An x-ray tube, comprising:

an evacuated envelope;

a cathode assembly disposed in the evacuated envelope, the cathode assembly comprising a cathode shield, a supporting body disposed inside the cathode shield, and an electron source attached to the supporting body and partially enclosed by the cathode shield; and an anode assembly disposed in the evacuated envelope, the anode assembly comprising a target configured to produce x-rays upon impingement by electrons produced by the electron source;

wherein the cathode shield comprises a shield base material and a layer over at least a portion of the base material, the layer comprises an emissivity enhancer having an emissivity greater than an emissivity of the shield base material, wherein the emissivity enhancer comprises titanium nitride or titanium aluminum nitride.

17. The x-ray tube of claim 16 further comprising an electrically insulating body defining an elongate receptacle configured to receive an electrical cable assembly to be coupled to the cathode assembly, wherein at least a portion of the insulating body is disposed inside the cathode shield.

18. The x-ray tube of claim 16 wherein the evacuated envelope comprises a cathode can surrounding the cathode assembly, wherein the cathode can comprises a can base material and an additional layer over at least a portion of the can base material, the additional layer comprises an additional emissivity enhancer having an emissivity greater than an emissivity of the can base material, wherein the additional emissivity enhancer comprises titanium nitride or titanium aluminum nitride.

* * * * *